US007896335B2

(12) United States Patent
Stemmle

(10) Patent No.: US 7,896,335 B2
(45) Date of Patent: Mar. 1, 2011

(54) PAPER HANDLING SCANNER SYSTEM

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 1391 days.

(21) Appl. No.: 10/914,771

(22) Filed: Aug. 9, 2004

(65) Prior Publication Data

US 2006/0033262 A1 Feb. 16, 2006

(51) Int. Cl.
*B65H 5/00* (2006.01)

(52) U.S. Cl. ..... 271/2; 271/125

(58) Field of Classification Search ..... 271/2, 271/125; 270/58.06, 58.09; 700/219, 220, 700/223, 228, 230
See application file for complete search history.

(56) References Cited

U.S. PATENT DOCUMENTS

| | | | | |
|---|---|---|---|---|
| 4,034,210 | A | 7/1977 | Hill et al. | |
| 4,517,650 | A | 5/1985 | Gomes et al. | 364/478 |
| 4,525,788 | A | 6/1985 | Gottlieb et al. | 364/478 |
| 4,527,468 | A | 7/1985 | Piotroski | 101/2 |
| 4,745,346 | A | 5/1988 | Muller | 318/685 |
| 4,800,505 | A * | 1/1989 | Axelrod et al. | 700/221 |
| 4,862,386 | A | 8/1989 | Axelrod et al. | |
| 5,142,482 | A * | 8/1992 | Sansone | 700/221 |
| 5,314,566 | A * | 5/1994 | Gallagher et al. | 156/441.5 |
| 5,339,603 | A | 8/1994 | Gombault et al. | |
| 5,561,963 | A | 10/1996 | Sytema et al. | |
| 5,640,835 | A | 6/1997 | Muscoplat | |
| 5,680,742 | A | 10/1997 | Hidding | |
| 5,683,338 | A | 11/1997 | Krasuski et al. | |
| 5,897,733 | A | 4/1999 | Stevens | |
| 5,967,504 | A * | 10/1999 | Yankloski | 271/2 |
| 6,230,898 | B1 | 5/2001 | Duffy | |
| 6,412,255 | B2 | 7/2002 | Hidding et al. | |
| 6,425,223 | B1 | 7/2002 | Miller et al. | 53/381.6 |
| 6,714,835 | B1 * | 3/2004 | Hart et al. | 700/220 |
| 6,725,126 | B1 * | 4/2004 | Doery | 700/221 |
| 6,732,011 | B1 * | 5/2004 | Hart et al. | 700/223 |
| 6,901,312 | B2 * | 5/2005 | Hart et al. | 700/223 |
| 7,219,482 | B2 * | 5/2007 | Stemmle | 53/429 |

FOREIGN PATENT DOCUMENTS

| | | |
|---|---|---|
| FR | 2717715 | 9/1995 |

* cited by examiner

*Primary Examiner*—Stefanos Karmis
*Assistant Examiner*—Jeremy Severson
(74) *Attorney, Agent, or Firm*—Angelo N. Chaclas; Steven J. Shapiro

(57) ABSTRACT

A scanner system for use with a paper handing system includes a scanner having a media feed path and which detects the physical characteristic data of documents transported along said feed path for scanning by said scanner. A paper handling subsystem is provided having a least one actuator coupled to control a mechanism adjustable to settings to adjust the subsystem to be set to process media having different physical characteristics.

20 Claims, 6 Drawing Sheets

PAPER HANDLING SCANNER SYSTEM

RELATED APPLICATIONS

The following application has common inventorship, filing date, and assignee and relates to paper handling equipment: U.S. application Ser. No. 10/914,533, for Paper Handling Method And System For Document Folding For Windowed Envelopes, filed Aug. 9, 2004, in the name of Denis J. Stemmle and assigned to Pitney Bowes Inc., now U.S. Pat. No. 7,104,034.

FIELD OF THE INVENTION

The present invention relates to paper handling equipment scanner systems and more particularly to a system and apparatus for sensing the characteristics of documents to be processed by paper handling equipment.

BACKGROUND OF THE INVENTION

Paper handling systems frequently include both folding subsystems and inserter subsystems, often in combination with other subsystems such as postage meter subsystems, sorting subsystems, and stacking subsystems, although each of these subsystems can be separate stand-alone systems. To operate properly these systems require various adjustments which depend on the physical characteristics of the documents to be processed. Typical paper handling equipment adjustments may include, for example, gap setting for the drive and retard members of variable thickness document feeders, transport guide adjustment, folding stop plates and deflectors adjustment, timing information settings for jams and doubles detection, insert finger deployment adjustment, and glue line moistening adjustment. The specific physical characteristics of the media being processed include information concerning: mailing envelope size, shape, throat profile, flap profile, window size and location, and thickness; and the size, length and width, shape, and thickness of each of the other documents, mailpiece components, including any return envelope and other insertable materials, that will be included in a mail processing job. For matched mailings, where the envelope contents are specific to a recipient, information concerning the documents themselves is also relevant to insuring proper collation of the specific documents intended for a specific recipient. Typical components in a mail processing job include a mailing envelope and various sheets that are fed, accumulated, folded and inserted, along with a return envelope, into the mailing envelope and thereafter franked, sorted and stacked. Other elements of a mail piece might include cards, pre-printed glossy sheets, brochures, tri-fold inserts, etc. Accordingly, proper adjustment of paper handling equipment for a mail processing job can involve significant complexity due to the multitude of potential component types and the large number of necessary adjustments.

Prior systems for adjusting paper handling equipment often involve trial and error efforts on the part of an operator in setting up the equipment. When adjustments are required to adapt the equipment to handle mail piece components with a variety of dimensions, thicknesses, etc, if the adjustments are not make correctly, the performance of the equipment will be degraded. For example, if feeder gaps are not set correctly, misfeeds or multifeeds can occur. If the feeder sideguide is not set correctly, skew feeds or misfeeds can occur. If envelope stop position at an insertion station is not set correctly, the jam rate during the insertion process might be adversely affected.

Variations in the media can create problems in the adjustment of paper handling equipment, such as the need to correctly set the position of the side guide for the stack of media being loaded. For example, envelopes tend to be manufactured with generous tolerances on the width dimension. If a side guide in the envelope feed tray is set too tight, it can result in misfeeds. If the side guide is set with too much clearance to the edge of the stack, it can result in skewed feeds. Because of the generous tolerances on envelopes, detent systems to locate the side guide at the correct position frequently results in misfeed or skew feed problems. Alternately, depending on operator to adjust the side guides in the correct position depends on the skill and experience of the operator with a specific piece of equipment and is often an error prone operation. The result is a higher fault rate for the equipment performance.

Additionally, many operators of such equipment are not familiar enough with the equipment to make the adjustments correctly on the first attempt. In some instances, operators may not be aware that adjustments are necessary. In other cases, the adjustments may require a significant period of trial and error before peak performance of the equipment is achieved. Even the simpler tasks of loading stacks of paper or envelopes into feeders for feeding can be performed incorrectly. For example, envelopes could be loaded upside down, or with the flap facing in the wrong direction. These errors will result in machine malfunctions, which require extra steps for the operator to clear jams and take other corrective actions before attempting to resume running a job. All of this results in longer job time and less efficiency.

Accordingly, it is desirable to quickly and efficiently obtain and employ information concerning the physical characteristics of the documents that will comprise a mail processing job, and use that information to either conduct adjustments automatically, or assist the operator in making the adjustments correctly the first time.

SUMMARY OF THE INVENTION

The present invention provides a system and apparatus for efficiently obtaining and providing information concerning the physical characteristics of media that will be part of a mail processing job to facilitate mail processing equipment set up and adjustment, and, if desired, the orientation of materials to be loaded into the system. The system and apparatus of the present invention processes media to provide information concerning the media surface, such as shape and size and also concerning the media thickness, that are critical characteristics of media relevant to paper handling equipment set-up adjustments. In accordance with aspects of the present invention, the system and apparatus reduce the need for operators to make trial and error adjustments in paper handling equipment to accommodate various media with different lengths, widths, thickness and shapes. In addition, the present invention will assist operators to set up equipment correctly for optimized performance on the first attempt without training or experience.

In accordance with the present invention, a system scanner system for use with a paper handing system includes a scanner having a media feed path and which detects the physical characteristic data of documents transported along said feed path for scanning by said scanner. In one arrangement, a paper handling subsystem is provided having a least one actuator coupled to control a mechanism adjustable to settings which adapt said subsystem to be conditioned to process media having different physical characteristics. A controller coupled between the scanner and the subsystem actuator. The controller processes data detected by said scanner to control the actuator to adjust the subsystem to a setting to process media having the physical characteristic detected by the scanner.

In another arrangement, the controller is coupled to a user interface. The user interface communicates to a user the determined setting for the subsystem to process media having the physical characteristic detected by said scanner.

As a feature of the invention, the arrangement of user interface and setting of the subsystem by the user may be employed with paper handling systems that include actuators where the user may elect to implement or vary the determined subsystem setting. The user interface, if desired, may also be used to communicate to the operator where to load materials for each element of the mailpiece, and in what orientation for correct operation of the equipment.

In accordance with yet another aspect of the invention, the scanner includes an array of sensing elements for scanning objects which move across the sensor elements. A feed path is arranged for transport of media of variable thickness along the feed path across the sensor elements. A moveable member is mounted along the feed path and is moveable by media transported along the feed path a distance related to the thickness of a transported media. A linkage is coupled to the moveable member and is mounted to engage and move across the sensing elements a distance that is related to the distance of movement of said moveable member such that said sensor elements detect linkage movement related to the thickness of the transported media. The moveable member may be part of a variable thickness media transport drive.

BRIEF DESCRIPTION OF THE DRAWINGS

Reference is now made to the various figures wherein like reference numerals designate similar items in the various figures and in which.

DETAILED DESCRIPTION OF THE PREFERRED EMBODIMENT

Figure 1:
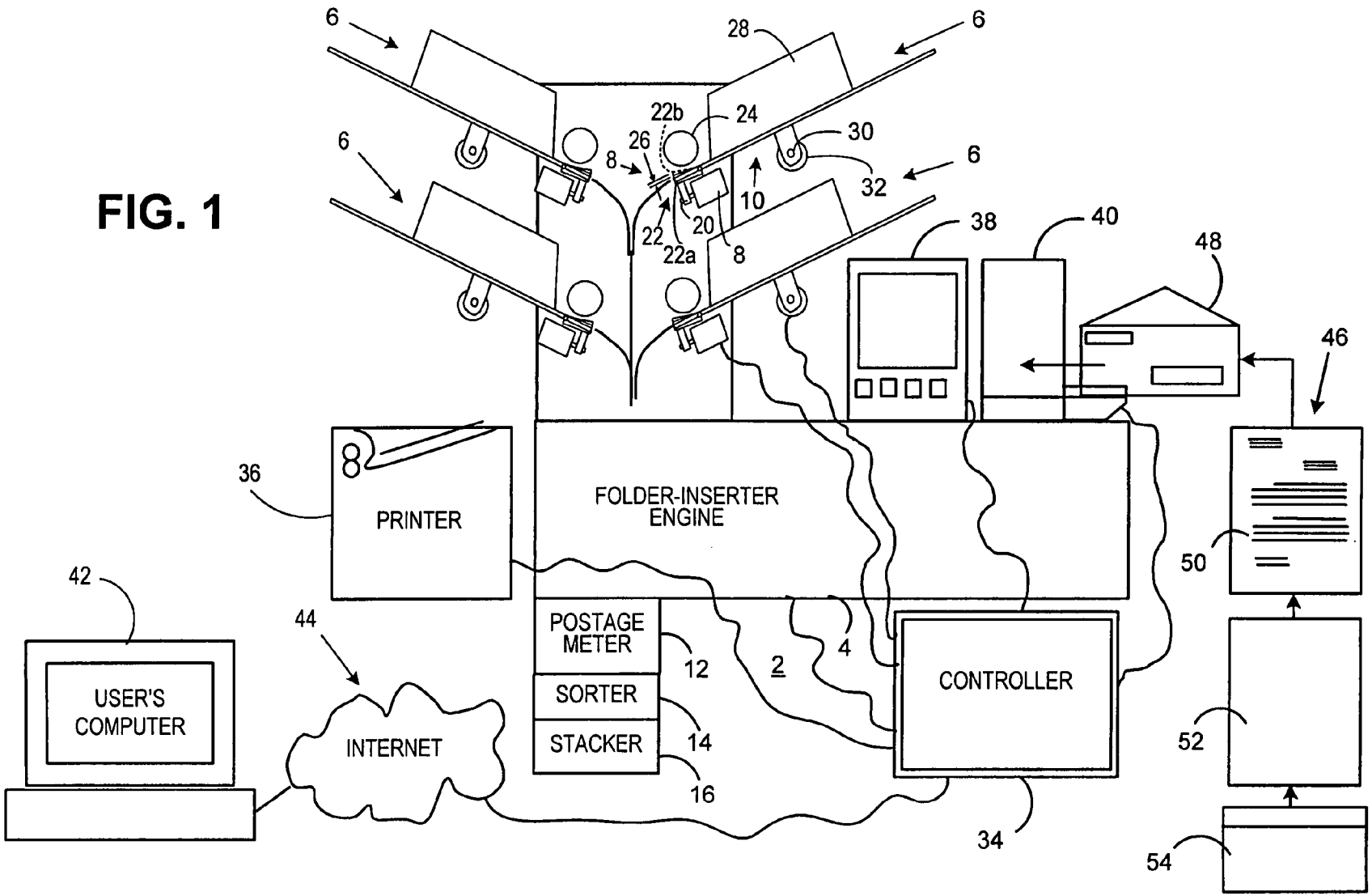
FIG. 1 is a block diagram of paper handling equipment system employing a scanning system embodying the present invention and showing details of an automatically adjustable variable thickness feeder.

Reference is now made to FIG. 1. Paper handling equipment 2 includes a folder subsystem and an inserter subsystem forming folder-inserter engine 4 and variable thickness feeders 6. The variable thickness feeders are adapted to feed different insert material to an accumulator station within the paper handling folder-inserter engine 4 where the accumulated material is folded. Each of the variable thickness feeders 6 includes an automatic gap adjustment mechanism 8 and an automatic side guide positioning apparatus 10. This enables the system through the automatic setting of the gap between the feed member and the retard member to accommodate different thickness material and by the automatic setting of the side guide to accommodate different size documents. The paper handling system 2 can include other subsystems such as a postage meter subsystems 12, sorting subsystems 14, and stacking subsystems 16. Each of these subsystems, including the folding and inserting subsystems, can be separate standalone systems.

The automatic gap adjustment mechanism actuators 8 includes stepper motor 18 and a cam 20. The cam is rotated into a desired position by the stepper motor to position the pivotable retard member 22 to set the gap between the retard member 22 and the feeder member, driver roller 24. This allows the gap to be adjusted over the distance 26 as retard member moves between the position shown as 22*a* and 22*b*. The system, through the control of the stepper motor 18 automatically sets the gap between the feed member and the retard member to accommodate different thickness material. The gap is set to optimize the performance of the equipment by minimizing double-feeds and misfeeds of the particular media being processed. The feeder side guide 28 is adjusted by the lead screw 30 which is rotated by stepper motor 32. This enables the feeder side guide to be moved to accommodate different width documents. Adjustable side guides may be employed throughout the paper handling equipment 2 to condition the paper path to handle different width media. The gap and guide actuator assemblies are conventional and may be of any type which operate to control settings of equipment.

It should be expressly noted that the automatically settable gap adjustments and automatically settable side guide adjustments are representative of the types of various adjustments associated with paper handling equipment that can be automated as part of the paper handling system 2. This may include adjustments such as those associated with transport guide adjustment, folding stop plates and deflectors adjustment, timing information settings for jams and doubles detection, envelope throat insert finger adjustment deployment, and glue line moistening adjustments. As with the gap adjustment mechanism 8 and the side guide positioning mechanism 10, the mechanisms and apparatus would be automatically adjusted by means of various combinations of suitable apparatus and devices, such as cams, lead screws, solenoids, stepper motors and other suitable known mechanism adjustment systems. All of these arrangements may be employed as adjustment systems for the various adjustable mechanisms in the paper handling equipment subsystems. The adjustment system employed will depend on the specific structure and operation of the particular paper handling equipment 2 subsystems mechanism to be adjusted.

For example, the variable thickness feeders 6 can be used to feed a wide range of materials including thin single page small inserts, trifolded sheets and sixteen page bound brochures on glossy stock. Typically, an actuator will be used to modify the gap between the feeding element and retarding element of the paper feeder. Other actuators will be used to adjust the width of the side guides and the position of tail pieces. Similar actuators can be used to adjust other paper path elements such as folder fold plate stops and deflectors, inserter length and width adjustments, vacuum and finger based envelope opening devices, which can be positioned optimally based on the exact shape of the envelope throat, flap opening, moistening, and sealing elements, which can be optimally deployed based on the exact shape of the envelope flap, media stop position and stacking elements. If the dimensions of the envelope are known because the scanner has captured this information, timing changes can be made to insure that the envelope stops in an accurate position at the insertion station. With more accurate stopping positions, the insertion process is more reliable. These actuator and/or timing adjustments, if desired, can be made in real time as the scanner is measuring the paper elements.

The paper handling equipment 2 operates under control of a controller 34 which is connected to the paper handling folder-inserter engine 4, the variable thickness feeders 6, a user interface 38 and a scanner 40. The system may further include a systems printer 36. The user interface may include a touch screen display may be used for the used to facilitate operator control of the paper handling equipment. The user interface is a means of communicating with a user. Many different forms of communications and various arrangements for user communications may be employed as the user interface. The controller 34 may be connected to a user computer system 42, as for example via the internet, a local area network or other suitable communication system shown generally at 44. The controller provides processing and control logic for the system. This controller 34 functionality can be located in the various subsystems and may be a centralized or a distributed processing system. Mailpiece items shown generally at 46 including an envelope 48 and various document sheets 50 and 52 and a return envelope 54 are scanned by the scanner 40 as will be hereinafter explained. Other possible mail piece items not shown in FIG. 1, but which could be included in the mail piece and therefore scanned by the scanner include inserts such as cards, pre-printed sheets, either folded or un-folded, or multi-page brochures and the like. These are representative documents of those that will be loaded into the equipment to be processed to form a complete mailpiece. To obtain a greater accuracy and to accommodate possible variance in the physical characteristics of the documents, several of each representative mailpiece items may be scanned. The scanning mechanism, as is described in detail hereinafter, is employed to provide specific information to the controller 34 concerning the physical characteristics of representative items that will comprise the finished mailpiece. This information may be used in connection with the various settings for the adjustable mechanisms of the paper handling equipment 2 to properly run mail processing jobs involving items of the type scanned. The scanner 40 may be a separate system or employed as part of the paper handling system 2 to directly provide information to the controller 34. This information is used to optimize the performance of the folder-inserter engine 4 settings and the setting of the variable thickness feeders 6 and of other modules that may be part of the system, such as the postage meter subsystem 12, the sorter subsystem 14 and the stacker subsystem 16.

During scanning the thickness of a scanned mailpiece item is determine by the scanner 40 and communicated to the controller 34. Controller 34 determines the appropriate gap settings for the specific variable thickness feeder 6 to be employed for the item. If the equipment has actuators, automatic setting adjustment mechanisms, as is shown in FIG. 1, the gaps and the feeder settings can be automatically set through the actuators 8 and 10 shown in FIG. 1 and those, not shown, internal to the folder-inserter engine 4 and other subsystems. The user interface 38 may also display specific settings to be used by the operator to set the necessary equipment settings by hand if the equipment does not have automatic setting capability. Provision may also be made to override settings determined by the controller 34. The efficiency in adjustment of the feeder gaps and other folder-inserter engine settings as well as settings associated with other modules, such as, the postage meter subsystem, the sorter subsystem and the stacker subsystem, facilitates the use of standard adjustable modules and subsystem. This minimizes the need for special purpose subsystems and helps enable the use of a single type module or subsystem, such as a feeder or a folder, in a range of equipment and applications.

The commercially available Pitney Bowes Inc. Model DI 200, Model DI 350 and Model DI 400 are examples of paper handling equipment having automatic setting adjustment mechanisms. These inserter systems incorporate automatic adjustment of the folding mechanism. In making the adjustment, the Models 350 and 400 use a stepper motor and lead screw arrangement to move an end stop mechanism to the correct distance from the fold rollers. The Model 200 uses a servo motor controlled roller drive arrangement. In making the adjustment, the servomotor stops the roller rotation at a measured time from the detection of the sheet lead edge passing a sensor to initiate a fold. The stopped rollers are then reversed to cause the sheet to be driven toward the fold rollers.

Figure 2:
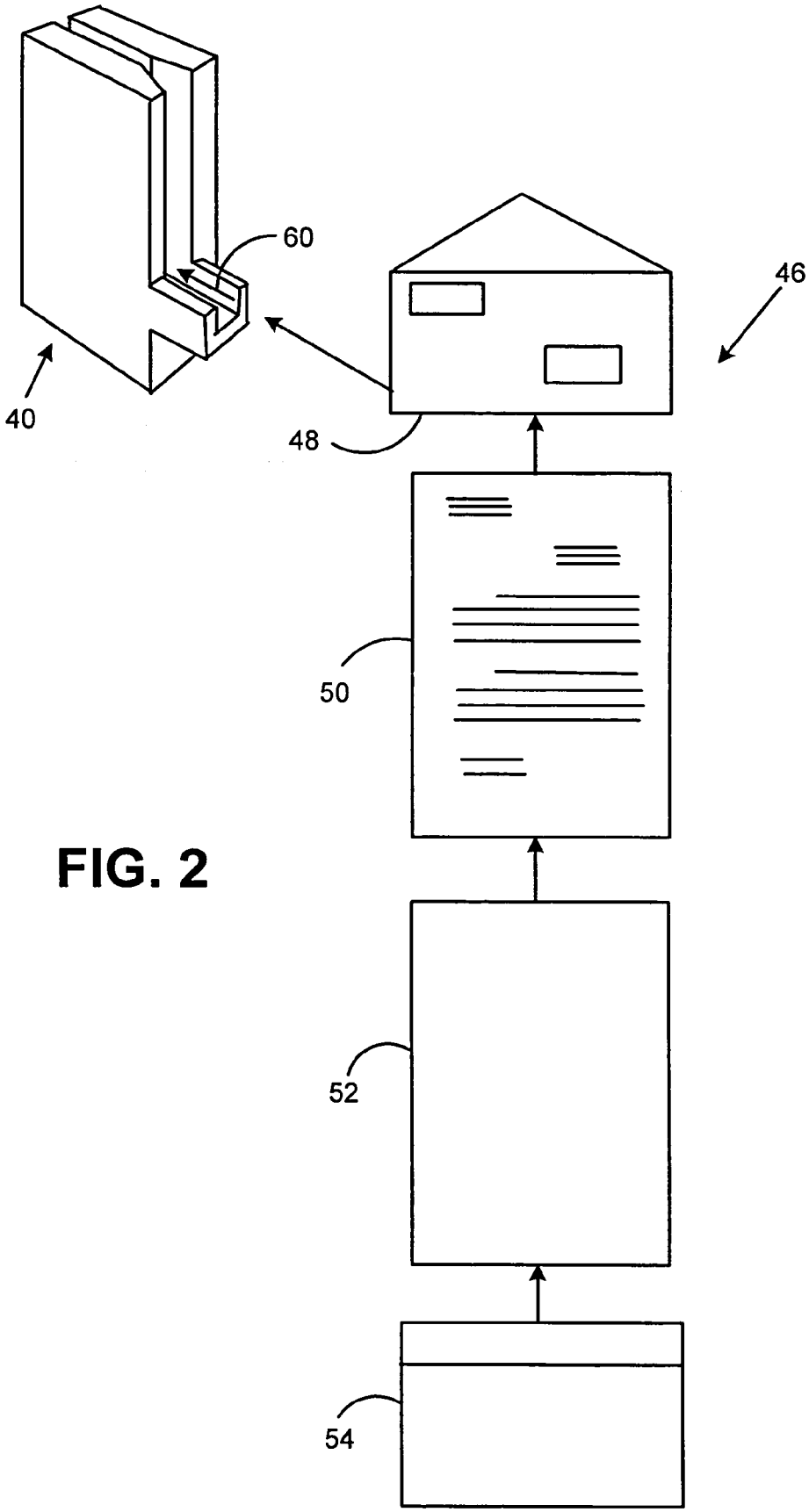
FIG. 2 is a perspective view of the exterior of the scanner shown in FIG. 1, showing the transport direction for a series of documents being fed to the scanner.
Figure 3:
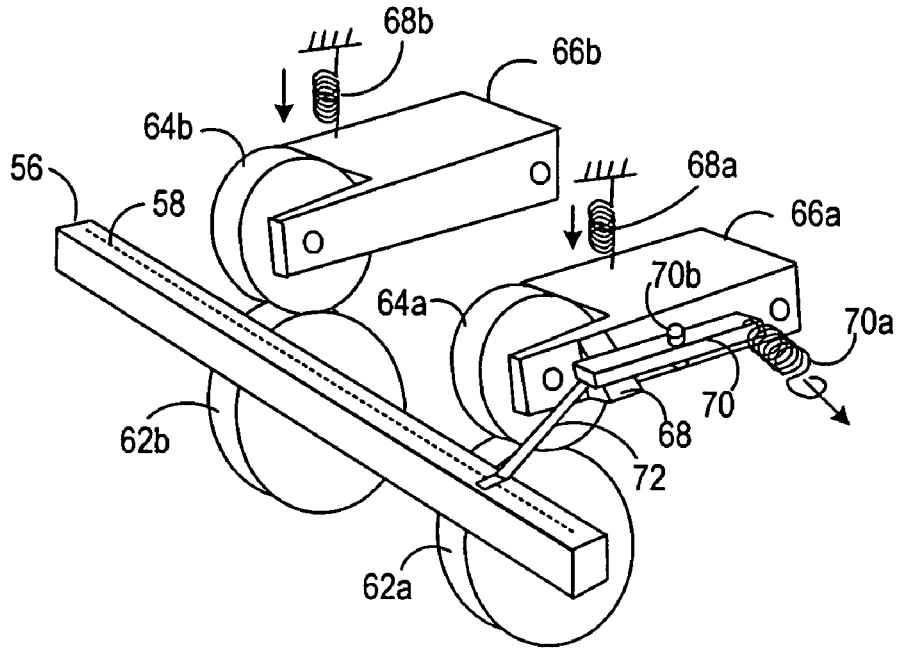
FIG. 3 is a perspective view of the scanner sensor system embodying features of the present invention and showing the scanner image sensor, document transport system and document thickness detection mechanism.
Figure 4:
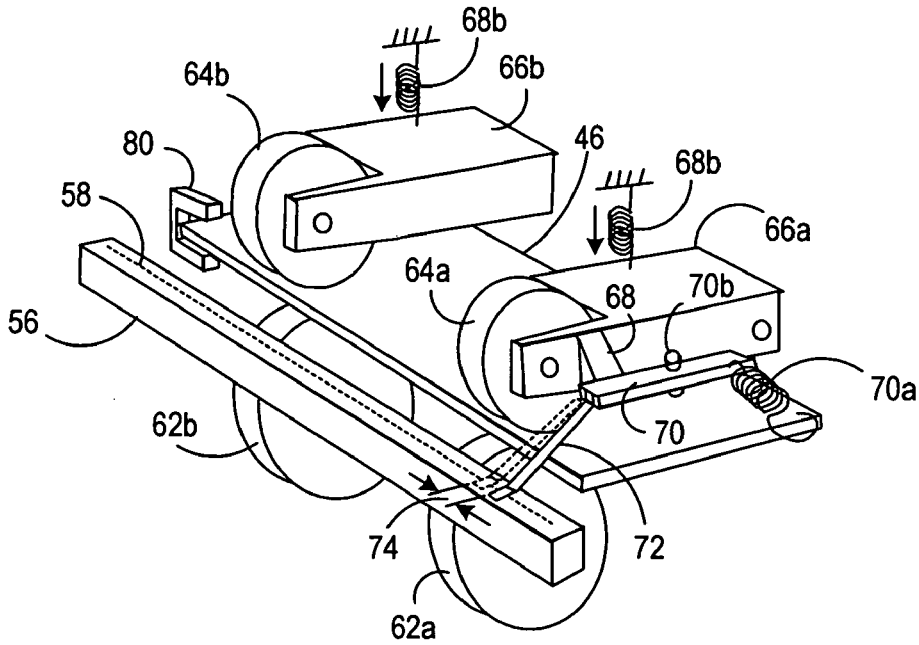
FIG. 4 is a view of the scanner sensor system shown in FIG. 3 with a document being transported by the scanner transport system toward the scanner image sensor.

Reference is now made to FIGS. 2, 3 and 4. A sensor 56, such as a contact image sensor, contains an appropriate array of sensing elements 58. These sensing elements 58 may be an illuminated strip of light emitting diodes (LEDs). One suitable contact image sensor is Dyna Image Company Model DL101-54A. Devices of this type are self-contained scanning elements used in various types of equipment for taking analog images and converting them into digital information. The mailpiece items 46 may be inserted into a slot 60 of the scanner 40. A sensor in the scanner feed slot 60 detects the presence of the mailpiece item and turns on the scanner transport drive for the drive rollers 62*a* and 62*b*. The details of the scanner feed slot sensor and roller transport drive are conventional and are not shown. If desired, a representative item of each the each mailpiece items 46 that will constitute the finished mailpiece may be fed into the scanner slot 40 in series. This provides information for the paper handling system controller 34 as to each of the various pieces or items that will compose the entire mailpiece and the order in which they are to be assembled. These mail piece items can include a windowed envelope 48, an address bearing document 50, a follow-on sheet 52 and a return envelope 54, and other elements such as cards, pre-printed sheets, brochures, etc. These various mailpiece items, are each media which can have a wide range of physical characteristics. The media may be processed by the paper handling equipment as individual items, a sub group of items or an entire group of items, depending on how the mail handling equipment is configured, the specific items composing the mailpiece and the specific paper handling job to be implemented.

Scanner drive rollers 62*a* and 62*b* operate in conjunction with idler rollers 64*a* and 64*b*. Idler roller 64*a* is mounted to a pivotable idler arm 66*a* and idler roller 64*b* is mounted to a pivotable idler arm 66*b*. Compression spring members 68*a* and 68*b* (shown in FIGS. 3 and 3*a* only) bias the idler arms into engagement with their respective drive rollers 62*a* and 62*b*. The idler arm 66*a* has a cam ramp-shaped surface 68, which is in engagement with a pivotable cam follower arm 70. The cam follower arm 70 is biased by a spring member 70*a* into engagement with cam surface 68. A flexible cam follower extension pointer 72 is attached to the end of the pivotable cam follower arm 70. The pointer 72 is in operative engagement with a portion of the sensor elements 58. As is shown in FIG. 4, as mailpiece item 46 is transported along a feed path to the sensor 56, the idler arms 66*a* and 66*b* with their respective idler rollers pivot in a direction to accommodate the thickness of the mailpiece items 46 (48, 50, 52 and 54, respectively) as those items are engaged by the scanner transport roller system. Because of the arrangement, the amount of movement of the idler arms 66*a* and 66*b* is dependent upon the thickness of the mailpiece item 46. The idler arms 66*a* and 66*b* each displace a greater distance from its drive roller for mailpiece elements of greater thickness. The pivotable cam follower arm 70 is caused to pivot about pivot 70*b* to move in a direction away from the idler arm 66*a* as the mailpiece item 46 passes between the drive rollers 64*a* and 64*b* and the idler rollers 66*a* and 66*b*. This is shown by the distance 74 that the pointer arm 72 moves across the sensor elements 58, which provides an indication of the thickness of the mailpiece item being transported. Additional means for reading the distance 74 are not required. The same sensor that reads length and width dimensions of the mail piece element also reads the thickness.

Figure 5A:
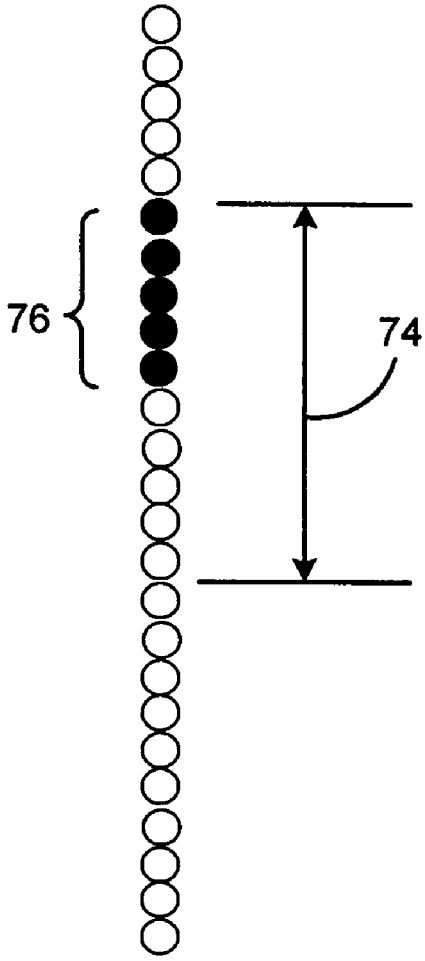
FIGS. 5*a* and 5*b* are a view of a portion of the scanner image sensor elements helpful in an understanding of the present invention; and, FIG. 6 is a flow chart of the operation of the system show in FIG. 1.
Figure 5B:
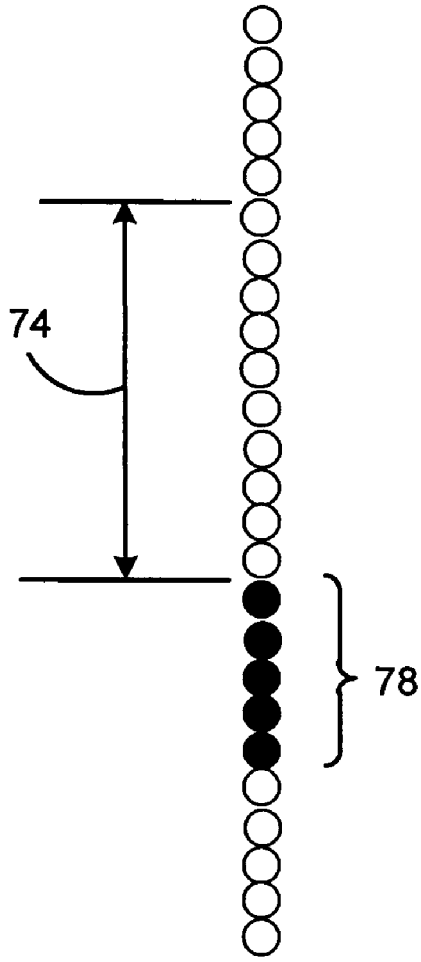

Reference is now made to FIG. 5*a* and FIG. 5*b*. As shown in FIG. 5*a*, which is a portion of the scanner elements 58, the captured image of pointer 72, which has a finite thickness, is located at position 76 when no mailpiece item is in the scanner transport mechanism. When scanner 40 transport rollers fully engage the mailpiece item, pointer 72 and moves to a new position. The transport idler arm cam 68 and the pivotable cam follower 70 move such that the pointer arm 72 moves a distance 74 to the new position, which is shown in FIG. 5*b* wherein the captured image of pointer 72 is now seen at 78. The distance 74 is the detected by those scanner elements 58 which are engaged by the pointer 38 before and during the transport of the mailpiece item toward the sensor 56. This information is communicated to the controller 34 and is processed by the controller to generate thickness information related to the specific mailpiece item being scanned.

The pointer arm 72 moves between its original and final position prior in time to the leading edge of the mailpiece item 46 reaching the sensor 56. When mailpiece item 46 reaches the sensor 56, it passes between the pointer arm 72 and the scanner elements 58. The mailpiece item 46 moves under the pointer arm 72 blocking the pointer arm 72 from operative engagement with the scanner elements 58. In this embodiment, as shown in FIG. 3 and FIG. 4, the data obtained from the movement of the pointer arm 72 is stored in a data memory for use when the scanning process is completed or can be immediately utilized, for example, to set the actuators of the variable thickness feeders 6, while other scanning operations continue.

Figure 3A:
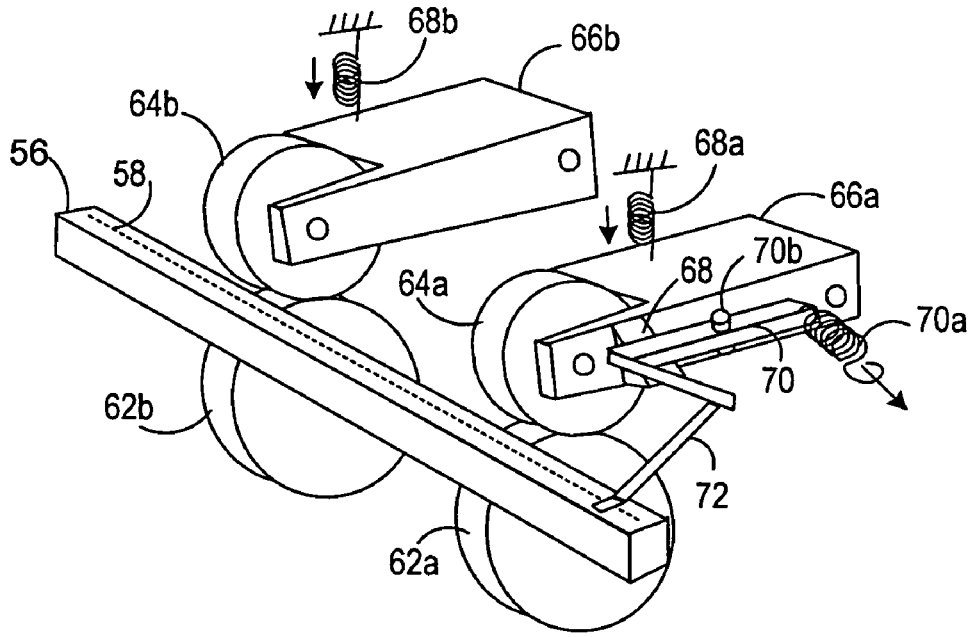
FIGS. 3*a* and 4*a* show an alternative embodiment of thickness detection aspects of the invention of the scanner sensor system shown in FIGS. 3 and 4.
Figure 4A:
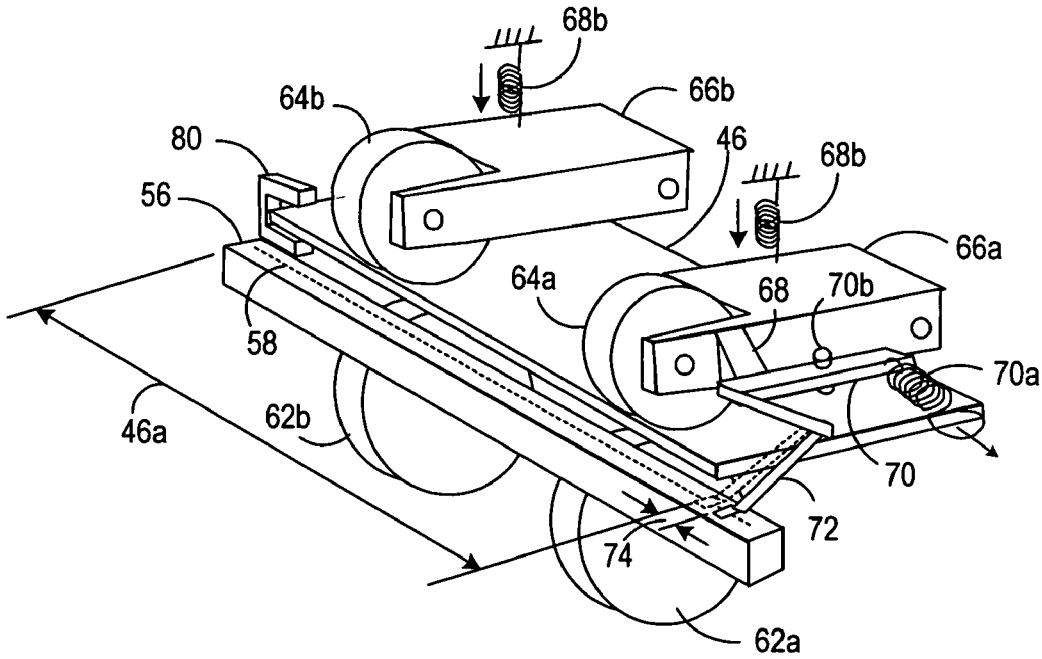

Another embodiment is shown in FIGS. 3*a* and 4*a* with a larger sensor 56 having a greater array of sensor elements 58. The pointer arm and the media each engage and move across different parts of the array of sensor elements. In such case, the pointer arm 72 is configured to engage portions of the scanner elements 58 not engaged by the mailpiece item 46. In this latter embodiment, it is possible to record a thickness profile over the entire length of the mailpiece item 46 as it is transported to engage and move across a different part of sensor 56. The thickness profile information can be used in adjusting the paper handling equipment for optimum performance.

An edge detector 80 (shown in FIGS. 4 and 4*a*) detects the lead edge of the mailpiece item 46 as it is transported to the sensor 56 along the feed path. The edge detector 80 operates to provide data as to when the mailpiece item 46 has fully engaged the idler and drive roller and when the pointer arm 72 has traveled its maximum distance across the scanner elements 58. The controller 34 uses this data to determine the position of the pointer arm 72 and thus the thickness of the mailpiece item 46. The edge detector 80 may also detect the trailing edge of the document 46, which enables a determination of the document length. For determining the shape of an envelope such as envelope 48, sensor 56 maps the envelope profile as the envelope (with the flap open) moves across the scanner elements 58. The sensor 56 may also determine the shape of the throat of the envelope, with the addition of a card of contrasting color inserted in the envelope if required. The envelope throat profile, that is, the shape of the opening into the envelope that is covered by the folded envelope flap, may be similar to or different from the envelope flap profile. The profile of the throat or the flap is mapped by the sensor by noting the edges of the flap or the throat at periodic increments as the envelope advances through the scanner. The sensor 56 also determines the width of the document 46*a* by the transition location of sensor element 58 covered and not covered by mailpiece item 46 as it passes across the sensor 56.

Figure 6:
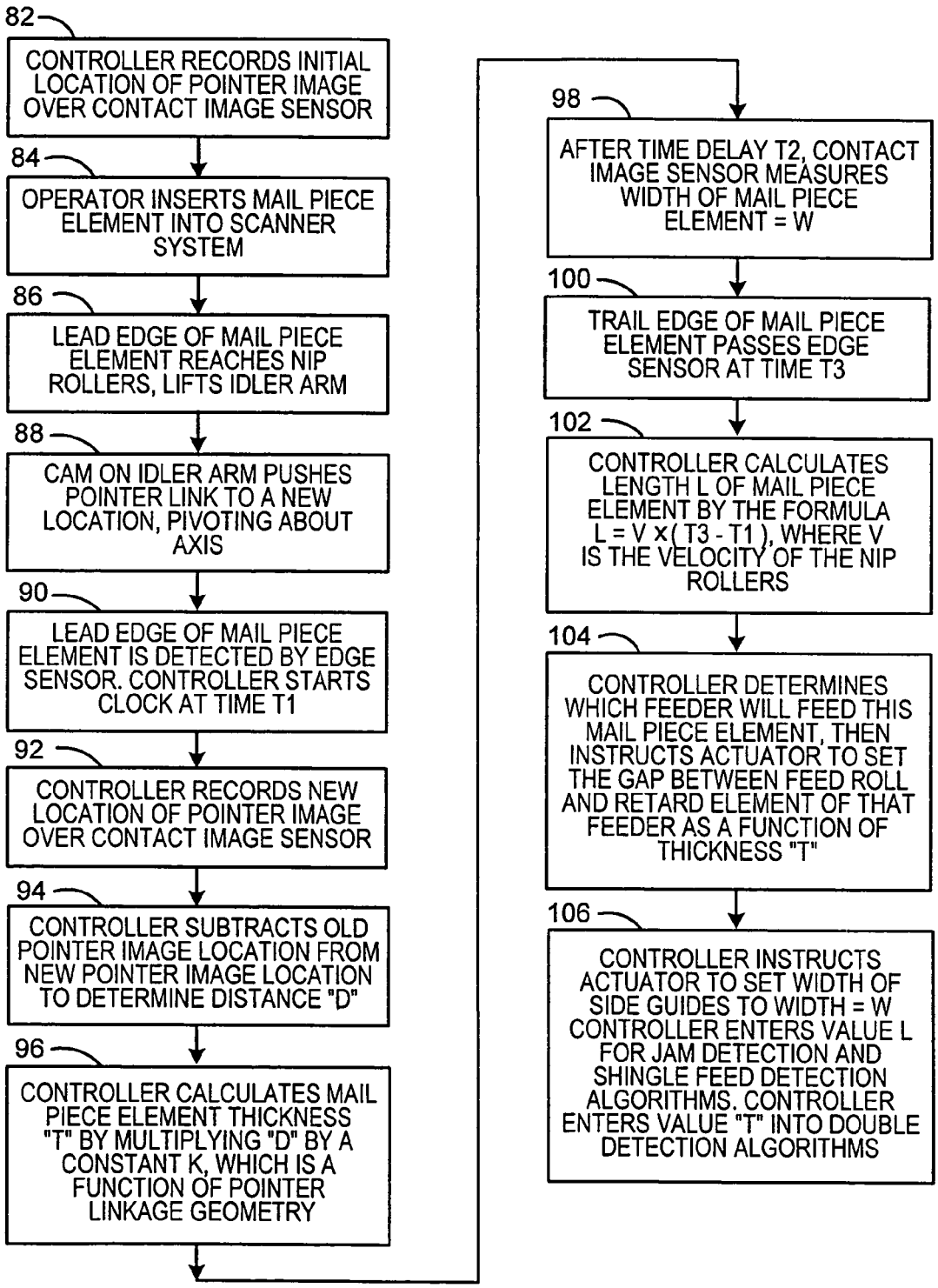

Reference is now made to FIG. 6. The controller 34 records the initial location of the pointer image over the contact image sensor at 82. The operator inserts a mailpiece item 46 into the scanner system at 84 and the lead edge of the mailpiece item reaches the nip of the idler and drive rollers (62*a* and 64*a*, and 62*b* and 64*b*) and lifts the idler arms 66*a* and 66*b* at 86. The cam 68 on the idler arm 66*a* pushes the cam follower arm 70 (pointer link) to a new position, pivoting about the rotational axis 70*b* at 88. The lead edge of the mailpiece item 46 is detected by the edge sensor 80 at 90, which enables the controller to start clocking at time T1.

The controller 34 records the new location of the pointer image 72 over the contact image sensor at 92 and processes the information at 94. The controller subtracts the old pointer image location from the new pointer image location to determine the distance d (74) and then further calculates at 96 the mailpiece item 46 thickness t by multiplying d by a constant K, which is a function of the pointer linkage geometry. This provides an indication of the actual thickness of the mailpiece item 46 being scanned. At 98, after a time delay T2, the contact image sensor measures the width of the mailpiece envelope element W (46*a*). The trail edge of the mailpiece item 46 passes the edge sensor 80 at time T3 at 100. At 102, the controller 34 calculates the length L of the mailpiece element by the formula $L=V\times(T3-T1)$ where V is the drive velocity of the drive rollers 62*a* and 62*b*. The controller at 104 determines which feeder will feed this mailpiece item 46 based on the sequence of feeding the mailpiece item into the scanner 40 and the item physical characteristics detected by the scanner system. The controller 34 then instructs the appropriate variable thickness feeder actuator 8 to set the gap between the feed roller and the retard element of that feeder as a function of the thickness t. Finally, at 106, the controller 34 instructs the actuator 10 to set the width of the side guides of the appropriate variable thickness feeder 6 to width W. If the paper handling equipment 2 has operation sensing means such as jam, shingle, and/or doubles sensing capabilities, the controller 34 enters the value L for jam detection and shingle feed detection algorithms and the controller enters value t into double-detection algorithms. The commercially available Pitney Bowes Inc. Model DI400 or Model DI800 inserting systems are examples of paper handling equipment with such capabilities.

In a fully automatic setup mode for paper handling equipment with this capability, rather than adjust the equipment, the operator simply inserts the envelopes, sheets of paper, inserts, and all other contents of the mailpiece one-by-one into the scanner device following the prompts on the user interface. The scanner 40 measures critical dimensions off the representative inserted material, and provides data to the system logic in the controller 34 to adjust the critical parameters of the paper handling subsystems automatically. Operator instructions on the user interface 38 screen can include directions to insert the envelope with the flap open into the scanner and then to insert the unfolded sheets into the scanner in the sequence they are to be found in the finished mailpiece. The interface may then instructs the operator that the system is ready to run the mail processing job and where and how to load all of the items forming a complete mailpiece. In this mode, no operator skill other than following the simple directions on the user interface are required.

Alternatively, the user interface can instruct the operator to manually adjust the settings of the paper handling equipment 2 by providing the specific characteristics of the mailpiece items and/or the specific settings for adjusting the setup of various paper handling equipment modules. Provision may be made to override settings determined by the controller 34. Additionally, all of the measured information can be stored in the system memory as a standard mail processing job if desired. In this way, any number of standard jobs can be stored by the operator and repeatedly used. When an operator selects a mail processing job stored in memory, the actuators automatically make all adjustments required while the operator is loading materials into the equipment. No additional activity is required by the operator such as re-scanning the mailpiece items of the job.

The system thus provides the ability to set the double-detect, jam prevention and other algorithms for the paper handling equipment 2 prior to the initial feed of the first set of materials from the variable thickness feeders 6. This provides the capability to avoid equipment malfunction problems from the outset, as opposed to adjusting the equipment based on the detection of jams and the like. Jam clearance is facilitated because malfunctions detection, for example, a double feed, occurs earlier in the process and before a second set of inserts are fed from the variable feeders 6 further jamming the equipment. Moreover, detecting double feeds early in the process minimizes the problem of the fed material being mutilated by the equipment. Accordingly, in such instances, there is an enhanced ability to recover the materials, re-insert them into the feeders and reconstitute the mailpiece being created. This is particularly important where matched mailing is being implemented, that is, where specific inserts go into specific envelopes to form a unique mailpiece.

The system lends itself to intelligent system adjustments while the equipment is running a job. The system may dynamically modify the setting of any adjustable mechanism to optimize the performance of the equipment. This may include dynamic adjustment of the settings for side guides and gap adjustment for each of the variable thickness, envelope stop positions, flap opening mechanism, throat opening mechanisms, moisteners, stacker guides, transport features for handing off mail pieces between inserters and meters, addressing equipment, etc.

If the system detects that a number of shut-down faults are attributed to any one feeder subsystem, the system can instruct the actuators to adjust paper path elements to improve the performance. For example, if the system detects a number of multifeeds, it can instruct the actuator to narrow the feeder gap. Or, if the system detects misfeeds, it can instruct the actuator to open the gap. Other adjustments in the various paper handling equipment subsystems can be handled in a similar manner. Alternately, if the system detects a number of faults from a particular subsystem, it can stop the mail processing job and instruct the operator, for example via the user interface touch screen display, to scan the mailpiece items again by re-inserting the item or items into the scanner 40 and then enable the actuators to re-adjust the critical paper path elements. Additionally, other information and subsystem setting adjustments may be communicated to the operator via the touch screen display such as how to load the envelope into a designated feeder, including orientation of the flap (face up or down, on the leading edge or trailing edge of the stack) and which media should be loaded into specific feeders so that the final mailpiece will be properly assembled by the equipment with the correct order and orientation of the media inserted into an envelope. Other displayed operator instructions may relate to the side guides settings and gap adjustment settings for each of the variable thickness feeders 6. Additionally, displayed operator instructions may relate to envelope stop positions, adjustments of flap opening mechanism, throat opening mechanisms, moisteners, stacker guides, transport features for handing off mail pieces between inserters and meters, addressing equipment, etc. By employing a touch screen display the operator by touching an appropriate screen area may implement or override a displayed setting for paper handling with actuators or manually adjust the setting for paper handling systems that do not include actuators. The system is thus very adaptable for use with a range of different types of paper handling systems and subsystems, whether or not they include automatic setting adjustments.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A scanner system for use with a paper handling system, comprising:

a scanner for receiving a plurality of representative media items along a media feed path; each of the representative media items being associated with an actual media item used in the fabrication of a finished mailpiece, the scanner operative to physical characteristic data of each of the representative media items;

a paper handling subsystem comprising a plurality of feeders for feeding actual media items associated with producing the finished mailpiece, each feeder comprising at least one actuator coupled to a respective adjustable mechanism for adjusting the mechanism to process each of the actual media items based upon the physical characteristic data of the respective representative media item; and, a controller operatively coupled to the scanner and the at least one actuator for processing the physical characteristic data of each of the representative media items and for controlling the at least one actuator to adjust the respective adjustable mechanism to process the actual media items of the respective representative media item.

2. A scanner system as defined in claim 1, wherein the adjustable mechanism comprises an adjustable media side guide and, wherein the at least one actuator controls the adjustable media side guide to a setting which adjusts the subsystem side guide to process media items having the physical characteristic detected by the scanner.

3. A scanner system as defined in claim 1, wherein the adjustable mechanism comprises an adjustable media feed gap mechanism and, wherein the at least one actuator controls the adjustable media feed gap mechanism to a setting which adjusts a feed gap to process each of the actual media items.

4. A scanner system as defined in claim 1, wherein the adjustable mechanism comprises an adjustable media position stop and, wherein the actuator controls the adjustable media position stop to a setting which adjusts the subsystem position stop to process media items having the physical characteristic detected by the scanner.

5. A scanner system as defined in claim 1, wherein the paper handling subsystem further comprises jam detection means coupled to the controller such that the controller is operable to input data detected by the scanner to the jam detection means.

6. A scanner system as defined in claim 1, wherein the paper handling subsystem comprises double detection means coupled to the controller such that the controller is operable to input data detected by the scanner to the double detection means.

7. A scanner system as defined in claim 1, wherein the paper handling subsystem comprises operations sensing means coupled to the controller such that the controller is operable to input data detected by the scanner to the operations sensing means and to receive data from the operations sensing means, and wherein said controller further controls the actuator to dynamically modify the subsystem setting based on data from the operations sensing means during operation of the subsystem.

8. A scanner system as defined in claim 1 wherein said scanner is adapted to detect the throat profile of an envelope transported along said feed path.

9. A scanner system as defined in claim 1 wherein said scanner is adapted to detect the flap profile of an envelope transported along said feed path.

10. A scanner system as defined in claim 1, wherein the scanner comprises:

an array of sensing elements for scanning the media items that move along the media feed path;

a moveable member mounted proximate to the feed path and moveable by the media items transported along the feed path a distance related to the thickness of the media items; and, a linkage coupled to the moveable member and mounted to engage and move across the sensing elements a distance related to the distance of movement of the moveable member such that the sensor elements detect linkage movement related to the thickness of the transported media items.

11. A scanner system as defined in claim 10, wherein the moveable member is part of a variable thickness transport drive mounted to drive media items of variable thickness to be transported along the feed path.

12. A scanner system as defined in claim 10, wherein the linkage is driven to engage and move across the sensing elements by the moveable member when media items being transported along the feed path are not engaging and moving across the sensing elements.

13. A scanner system as defined in claim 12, wherein the linkage is driven to engage and move across part of the array of the sensing elements which will engage said media items when the media items engage and move across the sensing elements.

14. A scanner system as defined in claim 10, wherein the linkage is driven to engage and move across a first part of the array of sensing elements by the moveable member when media items being transported along the feed path are engaging and moving across a second part of the sensing elements to provide a thickness profile of media items transported along the feed path.

15. A scanner system as defined in claim 1, further comprising a user interface for communicating to a user a setting of the respective adjustable mechanism coupled to the at least one actuator.

16. A scanner system as defined in claim 1, wherein the plurality of representative media items are chosen from envelopes, sheets, cards, pamphlets, and multi-page brochures.

17. A scanner system as defined in claim 1, wherein the controller further determines loading data for the plurality of feeders, wherein the loading data comprises at least one of an orientation of the media items and a scanning order of the media items.

18. A method of handling media items in a device having a paper handling subsystem comprising a plurality of feeders for feeding actual media items associated with producing a finished mailpiece, each feeder comprising at least one actuator coupled to a respective adjustable mechanism for adjusting the mechanism to allow the feeder to process the actual media items, the method comprising:

receiving a plurality of representative media items along a media feed path; each of the representative media items being associated with an actual media item used in the fabrication of a finished mailpiece in a scanner;

receiving a plurality of media items, the scanner operative to detect physical characteristic data of each of the representative media items;

detecting physical characteristic data of each of the representative media items;

processing the detected physical characteristic data; and controlling the at least one actuator associated with each feeder to adjust the respective adjustable mechanism to process the actual media items of the respective representative media item.

19. The method of claim 18, wherein the plurality of representative media items are chosen from envelopes, sheets, cards, pamphlets, and multi-page brochures.

20. The method of claim 18, further comprising determining loading data for the plurality of feeders, wherein the loading data comprises at least one of an orientation of the media items and a scanning order of the media items.

* * * * *